US005165674A

United States Patent [19]

Petersen

[11] Patent Number: 5,165,674

[45] Date of Patent: Nov. 24, 1992

[54] FOLDED SHEET PRODUCT OPENING AND TRANSFER SYSTEM, AND METHOD OF OPENING FOLDED SHEET PRODUCTS

[75] Inventor: Godber Petersen, Augsburg, Fed. Rep. of Germany

[73] Assignee: Man Roland Druckmaschinen AG, Offenbach am Main, Fed. Rep. of Germany

[21] Appl. No.: 742,024

[22] Filed: Aug. 8, 1991

[30] Foreign Application Priority Data

Oct. 24, 1990 [DE] Fed. Rep. of Germany ..... 4033759

[51] Int. Cl.[5] ..... B42C 1/00

[52] U.S. Cl. ..... 270/47; 270/54; 270/60; 270/55; 271/314

[58] Field of Search ..... 270/32, 45, 47, 48, 270/49, 51, 52, 54, 55, 57, 58, 60; 271/314, 315, 279, 306, 307

[56] References Cited

U.S. PATENT DOCUMENTS

| | | | |
|---|---|---|---|
| 2,626,074 | 1/1953 | Vogt | 270/55 |
| 3,269,720 | 8/1966 | Schluckebier et al. . | |
| 3,420,516 | 1/1969 | Guggisberg . | |
| 4,079,928 | 3/1978 | Weshenfelder | 270/55 |
| 4,775,136 | 10/1988 | Petersen . | |
| 4,807,865 | 2/1989 | Kobler et al. . | |
| 4,886,260 | 12/1989 | Reist | 270/47 |
| 4,989,850 | 2/1991 | Weller | 270/45 |

FOREIGN PATENT DOCUMENTS

| | | | |
|---|---|---|---|
| 210633 | 2/1987 | European Pat. Off. | 270/45 |
| 2508194 | 9/1976 | Fed. Rep. of Germany . | |
| 221246 | 9/1967 | Sweden | 270/55 |

*Primary Examiner*—Edward K. Look
*Assistant Examiner*—Therese M. Newholm
*Attorney, Agent, or Firm*—Frishauf, Holtz, Goodman & Woodward

[57] ABSTRACT

The folded products are not completely creased across their width in a folding apparatus but, rather, leaving an open loop or bulge or end portion (101). A separating cylinder (100) includes gripper or holding elements (38–41) located spirally about the circumference of the cylinder, in groups, and axially shiftable, for insertion of the grippers, sequentially, into said open loop. After the first gripper moves to an insertion position, it opens the sides of the folded products for insertion of subsequent grippers or holding elements along the length of the folded sheet. A fixed guide element strips the folded sheets off the cylinder, at which time the grippers, sequentially, withdraw from the insertion position, the trailing gripper elements holding that one (8) of the folded sheet portion which is closest to the cylinder against the circumference thereof, whereas the other portion (7) can fly out under centrifugal force, to thereby provide the folded product in separated form to a subsequent transport or storage pocket system (75), for example in form of a zig-zag storage structure.

15 Claims, 8 Drawing Sheets

II
II
V
68
63
64;65
64;65
75
75
1
1
19
20
21
21
22
23
24
25
28
29
30
31
32
33
34
35
36
37
38
41
42
43
44
45
46
47
48
49
50
51
52
53
54
55
56
58
61
69
70
71
72
101

FOLDED SHEET PRODUCT OPENING AND TRANSFER SYSTEM, AND METHOD OF OPENING FOLDED SHEET PRODUCTS

FIELD OF THE INVENTION

The present invention generally relates to paper handling systems, and more particularly to such systems which are intended to open folded printed products and transfer the printed products such that the sheet portions are separated, or can readily be separated. These folded products may be formed by a single-ply sheet or may be multi-ply, that is, a plurality of superposed sheet elements.

BACKGROUND

It has previously been proposed to facilitate opening of folded products by forming a fold or crease line which does not extend entirely across the width of the folded product, so that, at the end portions, a somewhat open loop or bend will form. Projecting tongues or other elements can be introduced into this open bend, to later on permit opening the products again without introducing a marker strip or a holding strip from one side of the products. Such a system is shown in European Patent 0 250 758. The arrangement, however, does not permit folded products to be opened which arrive on a transport belt system in imbricated or shingled form. Specifically, the arrangement does not permit to open these folded products and, then, transfer them in spread-apart form to a subsequent transport and storage system which, for example, has individual pockets for individual ones of the folded printed products. This pocket system may, for example, be in form of an accordion-like pocket arrangement, so that the pockets can be spread apart to receive the folded products, and later on compressed for compact storage.

It has also been proposed, see European Patent 0 169 490, to grip folded sheets or packages of folded sheets on the leading folding back and then, with a back gripper, to grasp a fold end strip, and to open the folded sheet with centrifugal force. This system requires an opening or overfold strip, which increases the total paper consumption.

U.S. Pat. No. 4,807,865, assigned to the assignee of the present application, and the disclosure of which is hereby incorporated by reference, describes a transport device for folded products in which a belt or a chain runs in parallel to a transport belt system, the belt or chain being supplied with projecting finger or tongue elements which can laterally engage against the sheet or package of sheets in advance of the folding jaw cylinder, and which, then, can open the folded product in a path along the transport device. The path is comparatively long. This arrangement does not permit spreading apart folded products which are transported in shingled or imbricated form, and to then feed these products, as spread, to a subsequent storage or handling system.

THE INVENTION

It is an object to provide a system and method which is capable of opening folded products which are transported in a transport device in imbricated or shingled form, and to permit the thus spread products to be inserted in a subsequent transport or storage system, for example a movable zig-zag pocket arrangement, as well known and as described, for example, in the referenced U.S. Pat. No. 4,807,865 Köbler et al.

Briefly, the sheets are folded so that a crease fold is made along the back fold, leaving, however, only partly creased or somewhat open end portions. The folding sheet products are then transported by a transport and grouping system into a stream of imbricated or shingled folded products and, as such, delivered to a sheet separating cylinder. The sheet separating cylinder has at least one, and preferably a plurality of groups of holding elements. The individual holding elements in a group are located along the sheet separating cylinder in radially staggered, spiral position, that is, at decreasing radii from the axis of rotation, while being circumferentially offset with respect to each other. These holdig elments are controlled and guided to be inserted into the open end portions of the folded products in such a manner that, first, a holding element is inserted closest to the folded crease or back, and the subsequent elements of the group are introduced along the length of the end portion of the folded products. The holding elements engage the sheet portion which is closest to the cylinder against the cylinder and, as the cylinder rotates, the outer ones of the sheet portions will, under centrifugal force, fly outwardly. The products are guided, thus, to an insertion position where fixed guide elements, such as guide sheets, or guide panels, receive the products. The holding elements are sequentially withdrawn from the insertion positions of the folded products by axially shifting the holding elements out of the products, for example under control of one or more cam disks.

In accordance with a feature of the invention, thus, the folded products are first guided about a portion of the cirumference of the rotating separating cylinder while, sequentially, the holding elements are axially introduced into the only partly creased end portion, such that a first holding element is positioned close to the crease fold, while the remaining holding elements are positioned sequentially further along the length of the folded product. The folded products, with the elements inserted, are stripped off the cylinder by engaging the products against a fixed guide structure while, gradually, axially withdrawing the holding elements from the folded products so that the holding elements will retain that one of the sheet portions against the rotating cylinder which is closest to its circumference, while permitting the other sheet portion to come free of the cylinder under centrifugal force, and thereby separate the sheet portions. The arrangement then permits delivering the stripped separated sheet portions to a receiving structure which has receiving pockets including a separating means insertable between the respective sheet portions.

The system has the advantage that it can handle a substantial number of folded products, since the supply can be in imbricated or shingled form at high speed, while taking up only little space. The possibility to spread folded products which are delivered in imbricated or shingled form permits providing more time for the individual operating steps, since the speed of the folded products, when delivered in imbricated form, can be substantially less than folded products which are staggered end-for-end along the transport system. The stream of shingled products can be derived directly from a folding apparatus.

The structure and method of the present invention has the specific advantage that the holding elements, which may also be termed "gripper elements", and are provided in groups, already effect some spreading of the folded products during a partial revolution of the separating cylinder. Starting at the back edge or crease of the folded product, suitable lateral shifting of the holding elements or gripper elements, under suitable control, for example by a cam, permits insertion of a plurality of such elements or grippers at shortest time intervals, so that, as the products are spread, the grippers can then be withdrawn in the same sequence as they were inserted. In other words, the rearmost holding or gripper element will still retain the sheet portion against the circumference of the separating cylinder which is closest to it, which may, for example, be about halfway along the length of the folded product. This retains the portion for a relatively long period of time on the separating cylinder. Spreading, thus, can be obtained in a minimum space, since it is effected by a compact cylinder, rather than relatively long or space-consuming belt systems.

DRAWINGS

DETAILED DESCRIPTION

Figure 1:
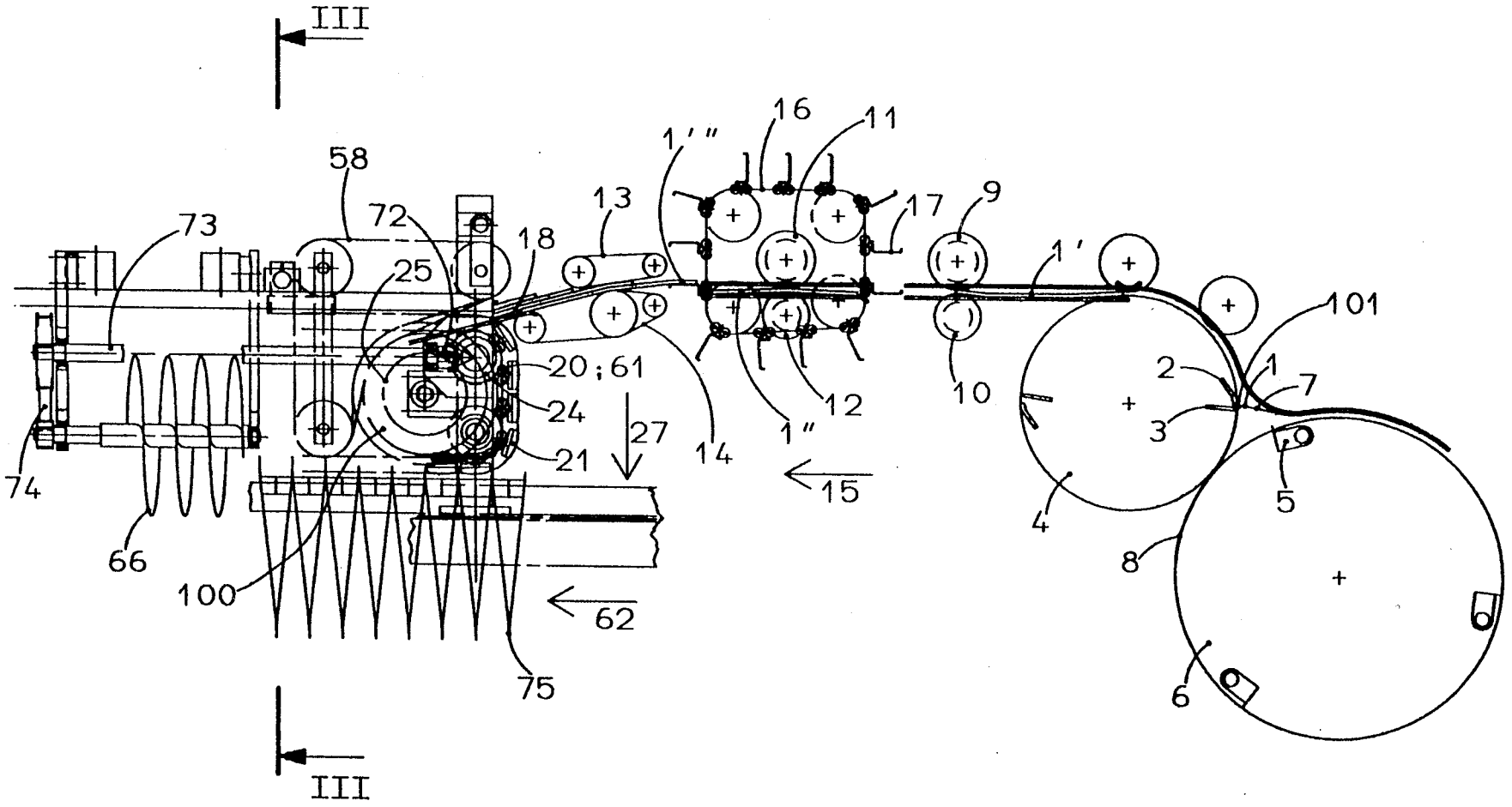
FIG. 1 is an overall front view of an embodiment of the present invention.

Referring first to FIG. 1;

To fold a sheet product, which may be a single sheet or a group of sheets, one above the other, hereinafter collectively referred to as "product", a product 1 is introduced, as well known, into a folding apparatus, not further identified in detail. The folding apparatus has a folding jaw cylinder 4 and a folding or tucking blade cylinder 6. The folding jaw cylinder 4 has folding jaw elements 2, 3, and the folding blade cylinder 6 has tucking or folding blades 5 thereon, operating as well known. The product 1, thus, is folded into two individual product portions 7, 8. In a preferred form of the invention, the folding operation is so carried out that the product 1 is not creased throughout its entire width but, rather, and as known, is creased sharply only throughout a major portion thereacross so that, at the end, an open loop or an open, partly creased or partly folded portion 101 will result. The European Patent 0 250 758 describes this arrangement, now well known, in detail. In subsequent transport, the now folded product 1 must be transported in such a manner that this partly creased end, and still partially open portion 101 remains outside of transport belts and other transport devices, so that this somewhat open loop is not compressed. Pulling rollers 9, 10 and 11, 12, as well as belt transport systems 13, 14, brake the folded product, as well known, so that the folded product, sequentially, reaches the positions 1', 1', 1'''. In the position 1''', the folded products 1 are already in imbricated or shingled position.

Figure 2:
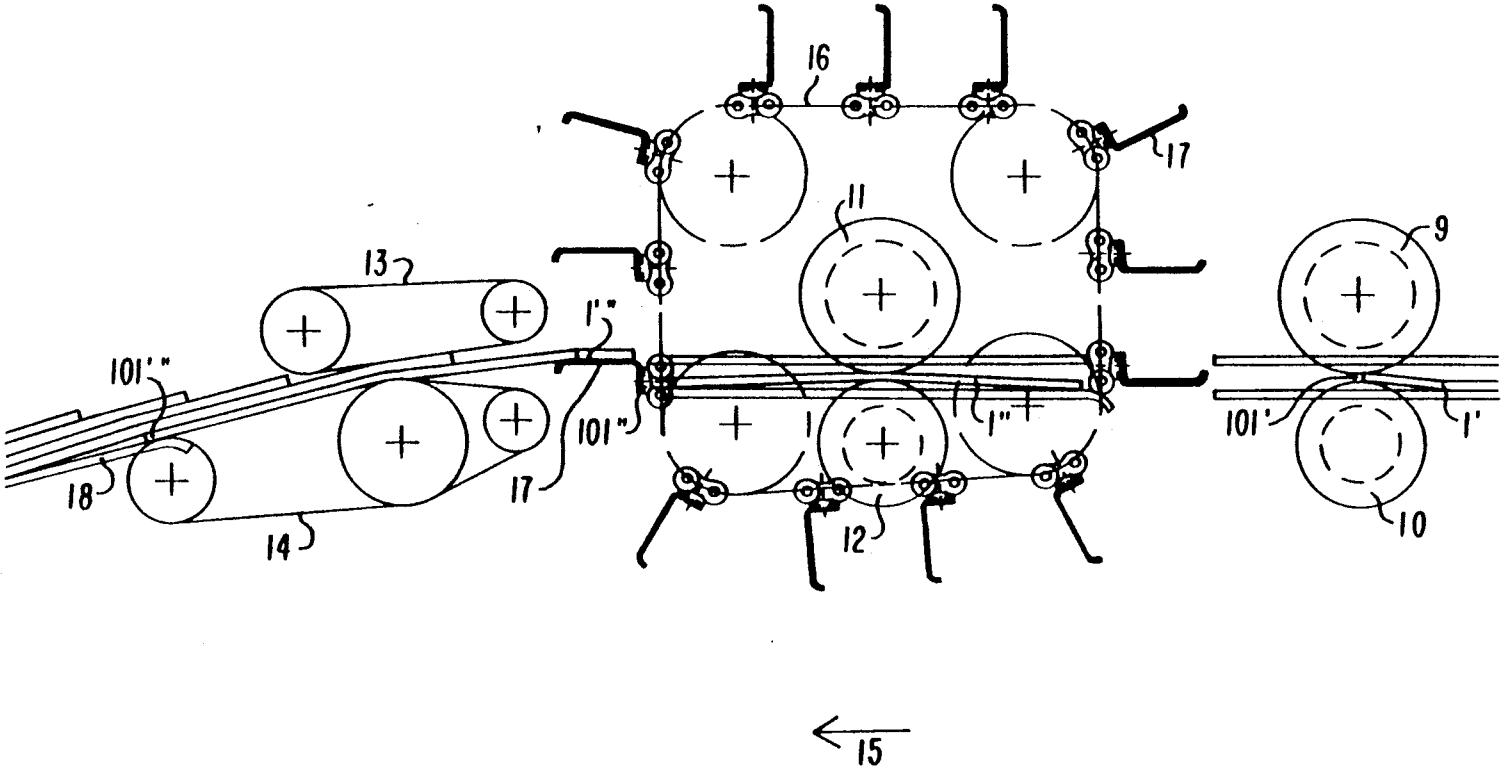
FIG. 2 is a fragmentary enlarged view of the system and illustrating the operation of the sheet imbricating arrangement.

In accordance with a feature of the invention, the retarding of the sheets from the folding apparatus, so that they will be delivered in imbricated position, is assisted by an endless chain 16 which operates in cadence in the direction of the arrow 15. The chain 16 is formed with projecting spoons 17 which engage in the gap between sequential products in the positions 1' and 1'' and, when they reach the position 1''', lift the end of the products so that the subsequent sheets will slip therebeneath to form the imbricated or shingled arrangement, in which the leading ends or folds are beneath the ends of the preceding product, also known as reverse imbricated position. FIG. 2 illustrates this procedure in greater detail. As can be seen from FIG. 2, the spools 17 fit underneath the sheets 1', for example by passing between sequential sheets 1' through gaps in guide sheets or the like, and then, when reaching the left-hand position with respect to FIG. 2, raise the trailing end of the sheets as seen at 1''' in FIG. 2. The rollers 9, 10, 11, 12 should be somewhat narrower than the width of the products to be folded, so that the end portions 101' of sheets 1', and portions 101'' and 101''' of sheets 1'', 1''', respectively, will not be compressed.

The folded products 1, 1'', 1''' are then delivered, in imbricated form, on a guide sheet 18 from which they are supplied to a separating cylinder 100.

Figure 3:
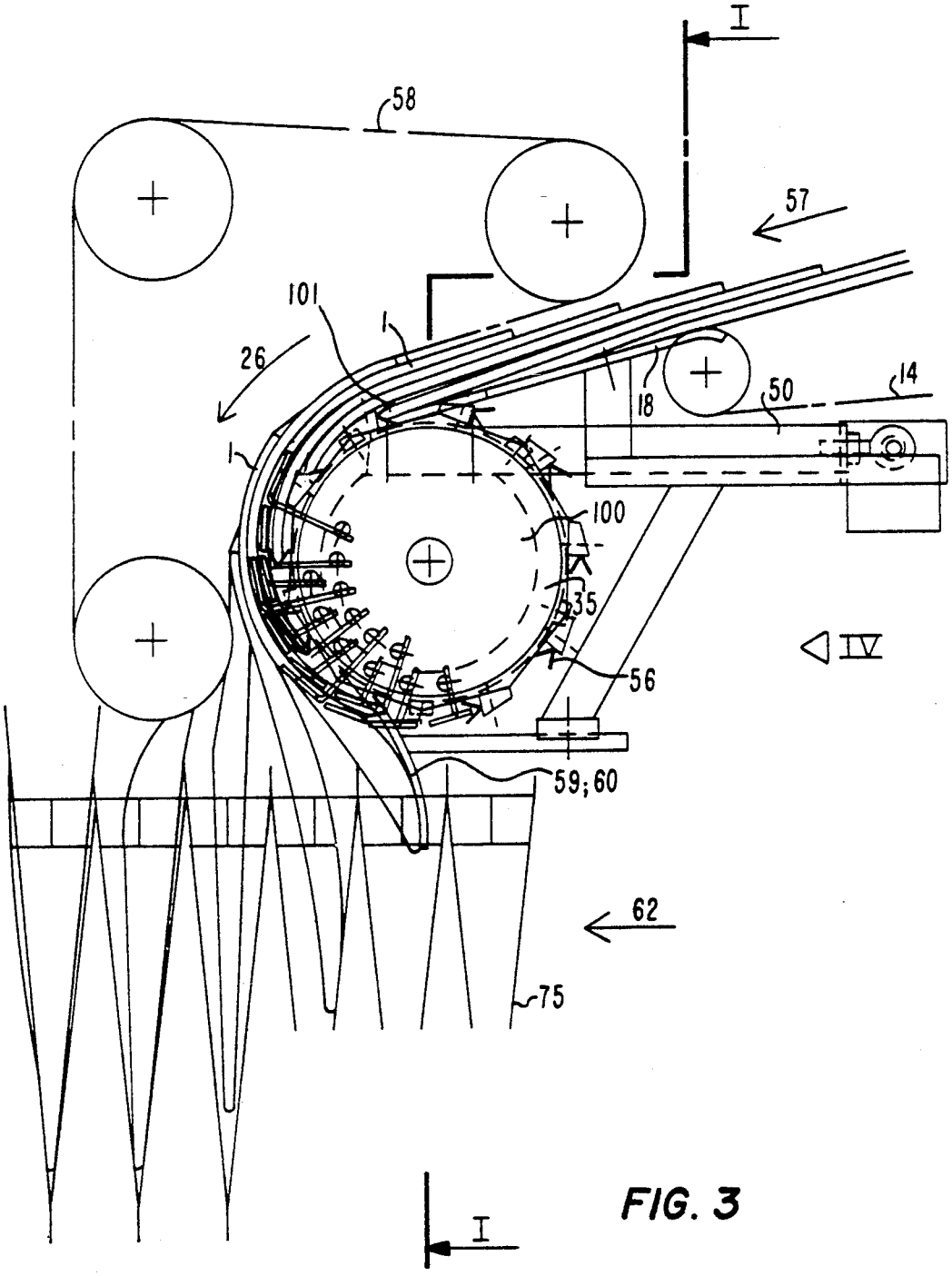
FIG. 3 is a fragmentary enlarged view of another part of the system.
Figure 4:
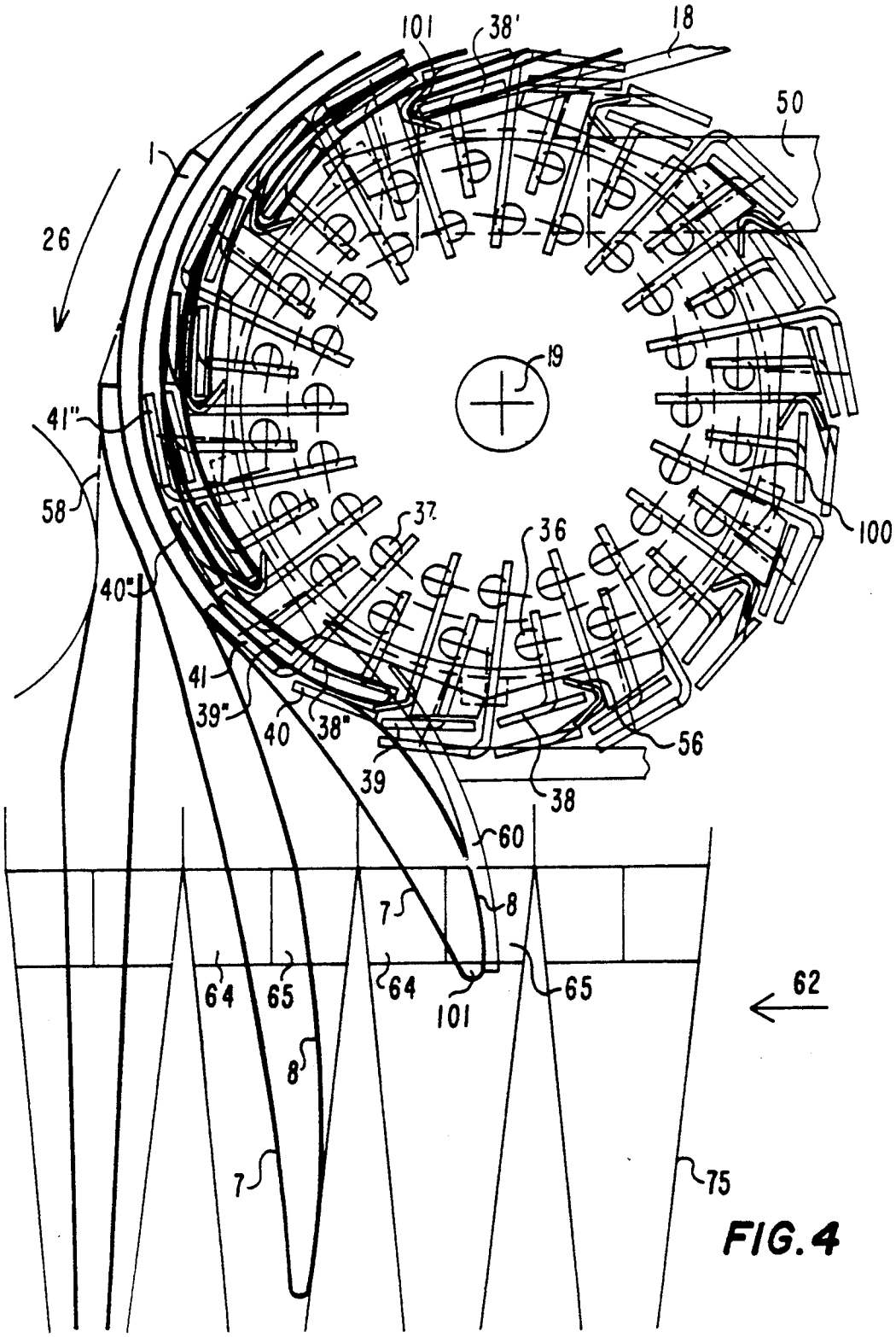
FIG. 4 is a fragmentary view of FIG. 3, and illustrating the operation of the sheet separating cylinder in combination with a product receiving pocket arrangement.
Figures 5, 9:
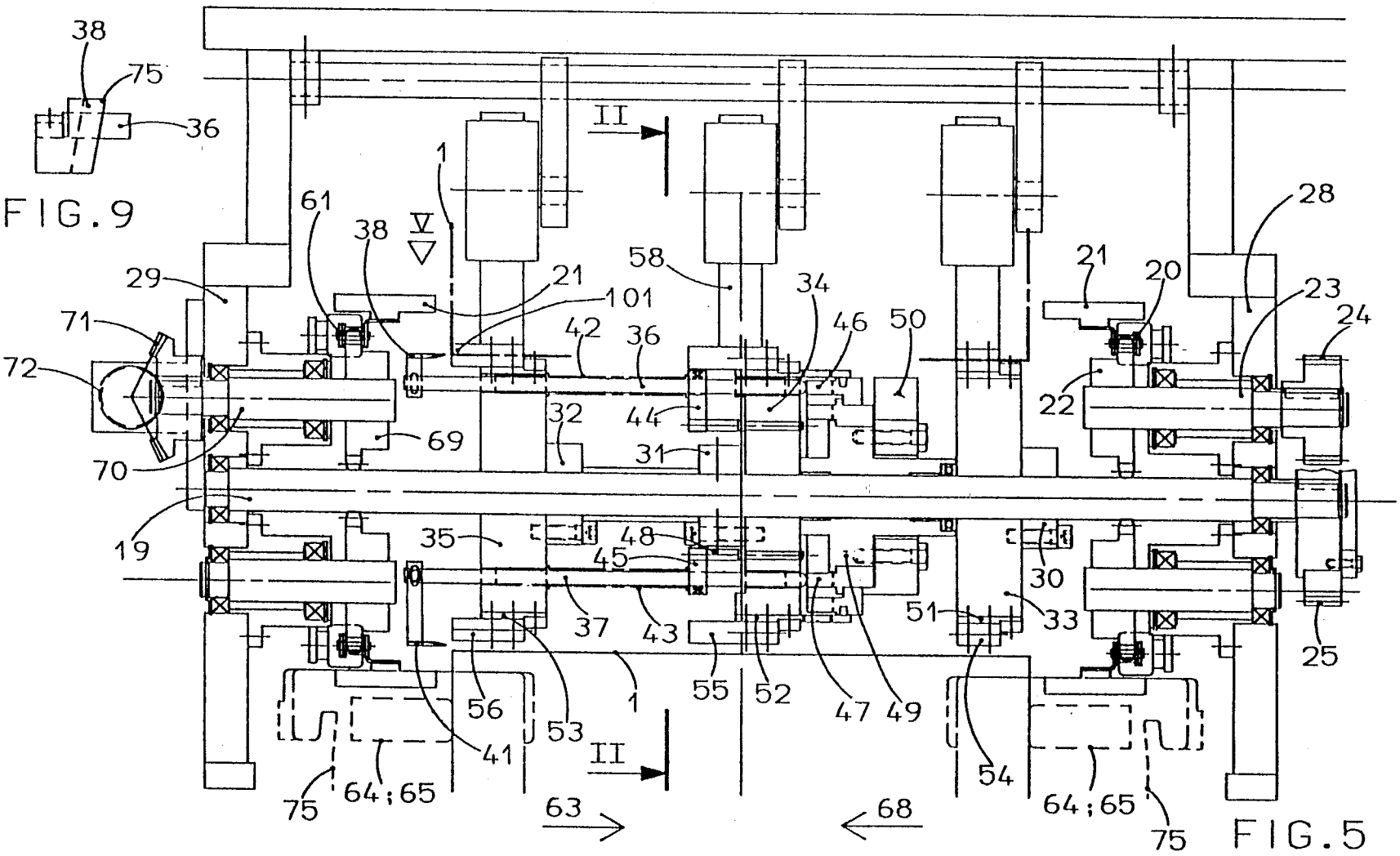
FIG. 5 is a sectional view along line I—I of FIG. 3.
FIG. 9 is a detail view in the direction of the arrow V of FIG. 5, illustrating a detail of the holding or gripper element.

Referring now to FIGS. 3, 4 and 5;

The shaft 19 of the separating cylinder 100 is driven in synchronism by a chain 20, which carries follower elements 21, a shaft 23, and spur gears 24, 25 in the direction of the arrow 26 (FIG. 3). The chain 20 moves in the direction of arrow 27 (FIG. 1). Shaft 19 is supported in support posts 28, 29. Disks 33, 34, 35 are secured to the shaft 19 by clamping elements 30, 31, 32. The disks 34, 35 retain a plurality of axially movable plungers 36, 37, on which holding elements or gripper elements 38, 39, 40, 41, respectively, are secured.

Figure 6:
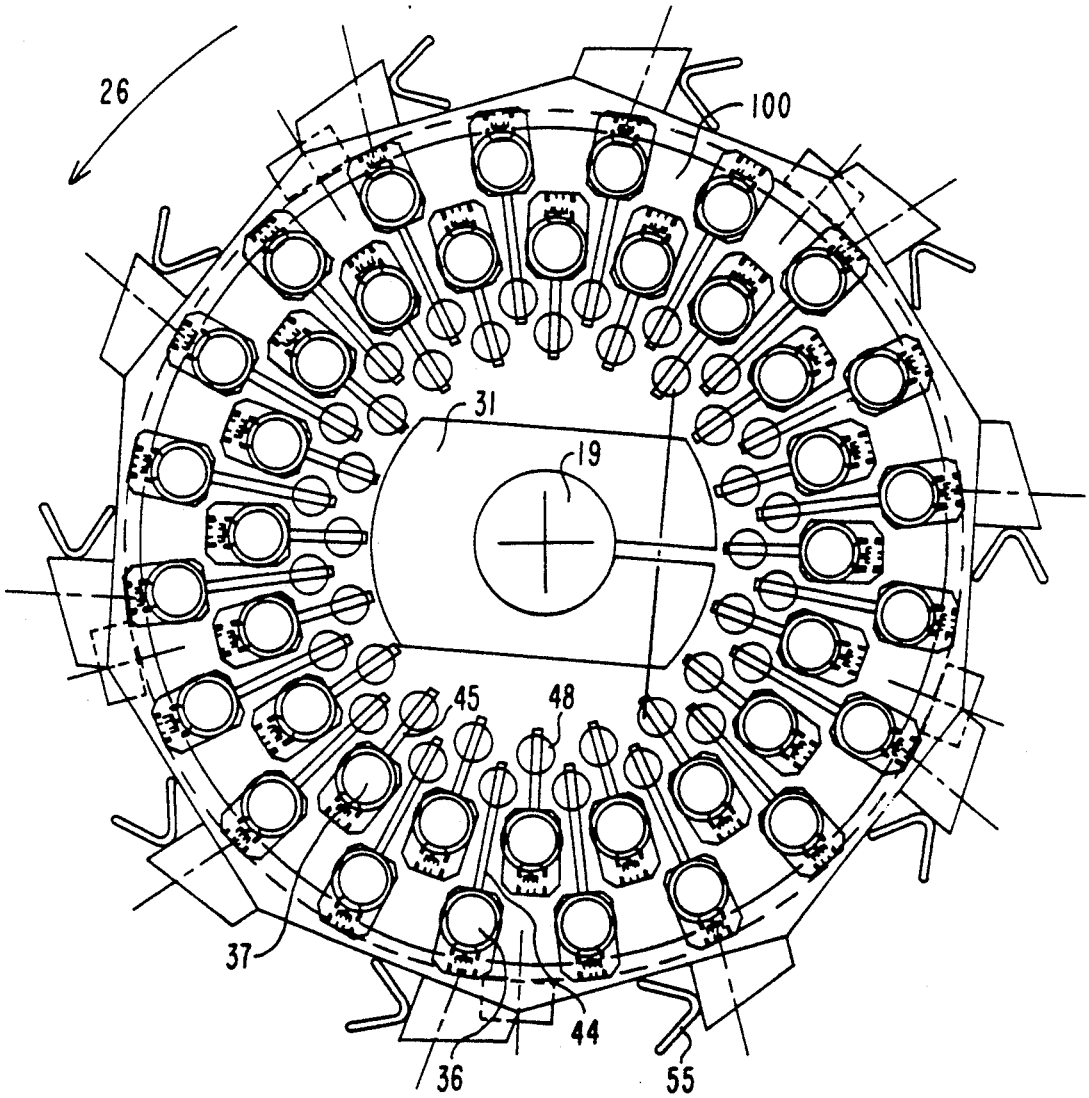
FIG. 6 is a section along line II—II of FIG. 5.

In accordance with a feature of the invention, the holding or gripper elements 38–41 are located in groups of four, spirally with respect to the center of the cylinder 100, see FIG. 4. They follow the course of the imbricated products 1 which fold themselves about the cylinder 100. As best seen in FIG. 5, the plungers 36, 37 are pressed against axial cam disks 46, 47 by compression springs 42, 43, and clamps 44, 45 engaging the springs. The holders 44, 45 are guided in split pins 48 to ensure that the plungers 36, 37 will not rotate but only move axially, see FIG. 6.

Figure 8:
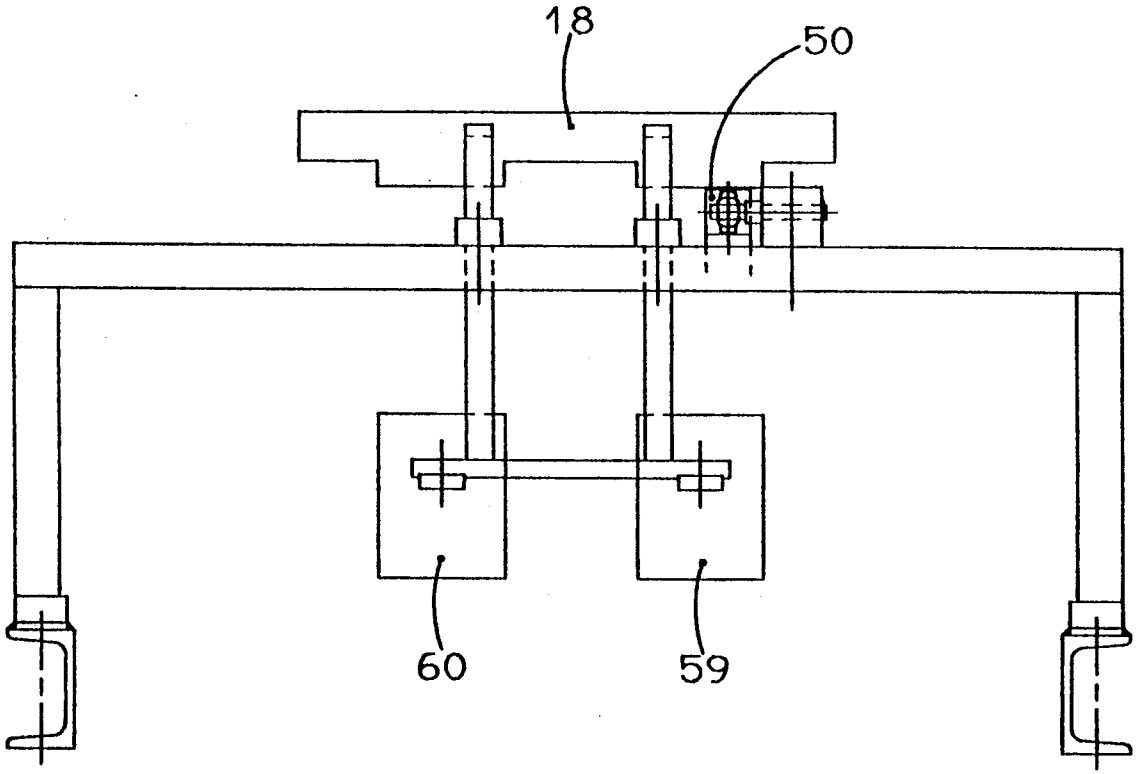
FIG. 8 is a fragmentary end view in the direction of the arrow IV of FIG. 3.

The axial cam disks 46, 47 are secured on the shaft 19 via a cam carrier, rotatable on the shaft 19, and supported by a torque block 50, see FIGS. 3, 5 and 8. Upon rotation of the cylinder 100, the plungers or pins 36, 37 and with them the gripper or holding elements 38–41, are moved axially back and forth, since the cam disks 46, 47 are fixed in position.

In accordance with a further feature of the invention, rings 51, 53, 54 are located at the circumference of the disks 33, 34, 35. These rings have abutments 54, 55, 56, preferably of angled shape, to engage the folded edge of the folded products 1, and to thereby align the folded products. This, also, causes the end portions or loops 101 to bulge, and open.

The circumferential speed of the separating cylinder 100 is less than the transport speed of the folded products 1, arriving in a direction of arrow 57 (FIG. 3).

Consequently, the folded products 1 are securely impinged against the stops or abutments 54, 55, 56, ensuring precise alignment. The transport belt system 13 is carefully so adjusted that the feed is just right with respect to the circumferential speed of the cylinder 100, that is, not too high to push too hard against the abutment, and not too slow, to leave some slack. Impinging the folded edge of the products against the abutments 54, 55, 56 increases the looped or open-end portions or the open bulge 101 of the folded products 1, so that the elements 38 can easily insert themselves between the product portions 7 and 8, forming the folded halves of the folded product 1, see position 38', FIG. 4. All the elements 38–41 are so shaped that, first, a tip 75 penetrates. This tip also facilitates overall penetration, see FIG. 9, which is a view in the direction of the arrow V of FIG. 5.

As the separating cylinder 100 continues to rotate in the direction of the arrow 26, the gripper or holding elements 39, 40, 41 sequentially penetrate between the product portions 7, 8 of the folded product 1. Each one of the elements, thus, opens the folded product for the next subsequent element for ease and exact insertion. The elements, additionally, clamp the product portion 8 of the printed product 1 securely against the circumference of the cylinder 100. At the outside, the products 1 are held by a web guide 58 against the circumference of the cylinder 100.

When the position 38" (FIG. 4) is reached, the first one of the four gripper elements 38–41 withdraws from the insertion position and releases its half of the product portion. Position 38" may be termed a terminal location for positive guidance by all the gripper elements. The product 1 is then deflected by fixed guide tongues or guide sheets 59, 60 (FIG. 3) and will come free from the abutment 54, 55, 56. The gripper or holding element 39, 40, 41 then sequentially release the product portion 8 from engagement with the cylinder 100, thus forming an opening between the product portions 7 and 8, and permit entry into a pocket structure 75.

The pocket structure 75 is a zig-zag pocket structure, in that it can form expanded and compressed pockets, in bellows-like form, which moves in the direction of the arrow 63, carried along by the chains 20 and 61 and the followers 21 thereon. The direction of rotation 26 of the separating cylinder 100 is counter the direction of movement of the structure 75, which accelerates the penetration of the products 1 into the zig-zag structure 75, see FIG. 4.

The details of the zig-zag holding or pocket structure to receive folded products is known, and described in the referenced Köbler et al U.S. Pat. No. 4,807,865. The two-part structure described in that patent is preferably used also in the system in accordance with the present invention. When the zig-zag structure is deflected laterally in the direction of the arrow 63, see FIG. 7, first one side of the folded product 1, namely that one which flies open (FIG. 4), enables the separating springs or tongues 64, 65 to penetrate between the halves or portions 7, 8. This opening is then shifted, by rotation of the worm 66 in the direction of the arrow 67 to the other side, which permits the storage and holding system 75, by deflection in the direction 68, to penetrate with its tongues 64, 65 between the sheet portions 7, 8. This penetration, entry and separating sequence is described in greater detail in the referenced U.S. Pat. No. 4,807,865, Köbler et al.

Figure 7:
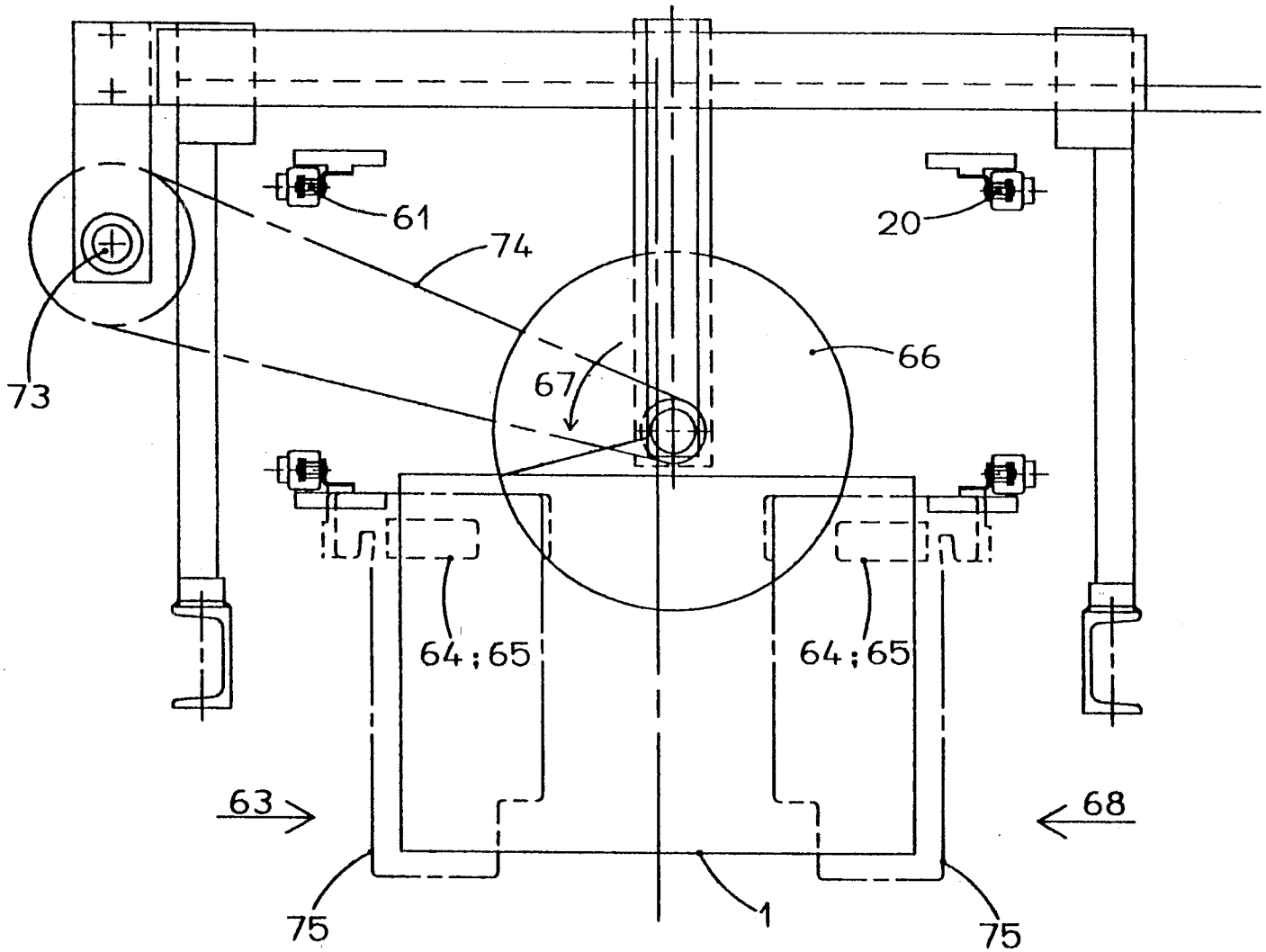
FIG. 7 is a section along line III—III of FIG. 1.

The folded products 1, thus, are sequentially stored in sequential pockets of the structure 75, as clearly seen in FIG. 4, and can be readily opened by expanding the pocket structure, for example to place insert sheets, weekly editions or advertising material between the folded portions 7, 8 of the product 1. As seen in FIGS. 1, 5 and 7, the worm 66 is driven in synchronism from the chain 61 through a sprocket 69, a shaft 70, bevel gears 71, 72, a shaft 73, and a gear belt 74.

Various changes and modifications may be made within the scope of the inventive concept.

I claim:

1. Sheet product folding and separating system having means (2, 6) for folding a sheet product (1, 7, 8), and defining two folded sheet portions (7, 8) while forming a crease fold, and leaving only partly creased, folded open looped end portions (101), and transport and grouping means (9–18) receiving said folded sheet products (1, 7, 8) and forming said products into a stream of imbricated or shingled products, comprising, in accordance with the invention, a sheet separating cylinder (100) receiving said products in said stream, said sheet separating cylinder having at least one group of holding or gripping means (38–41) wherein the holding or gripping means of a group are spirally located at decreasing radial distances from the axis of rotation (19) of the sheet separating cylinder, and spaced circumferentially about the cylinder, and means (36, 37, 46, 47) are provided for controllably axially shifting said holding or gripping means by sequentially controlling introduction of the holding or gripping means into the partly creased, folded, open loop end portions (101) at an insertion position;

means (58) for guiding the products, with said group of holding or gripping means inserted into the end portions (101) of the product over a predetermined range or portion of a revolution of the separating cylinder 100, and ending at a terminal location; and fixed guide means (64, 65) receiving said products, positioned beyond, with respect to the direction of rotation of the cylinder, of the terminal location, and wherein said axial shifting control means (36, 37, 46, 47) controls the holding or gripping means (38–41) to sequentially withdraw from said insertion position by axially shifting of the holding or gripping means laterally out of the products, said holding or gripping elements retaining that one (8) of the sheet portions (7, 8) against the rotating separating cylinder (100) which is closest to the circumference of the cylinder, while permitting the other sheet portion (7) to come free of the cylinder, when beyond said guide means (58) and swing outwardly with respect to the cylinder under centrifugal force, to thereby separate said sheet portions.

2. The system of claim 1, wherein said transport or grouping means comprises an endless belt means (16), said belt means having lifting spoons (17) secured thereto, traveling in the direction of the transport means, and lifting the trailing end of a sheet product above the leading end of a subsequently following sheet product, to form a reverse imbricated or shingled product stream.

3. The system of claim 1, wherein said sheet separating cylinder (100) is formed with circumferentially spaced abutment means (54, 55) to receive the folded crease of said products and align said products on the cylinder; and wherein said cylinder rotates at a circumferential speed which is less than the speed with which said imbricated products are supplied thereto by said transport and grouping means (9–18).

4. The system of claim 1, wherein said holding and gripping means comprise essentially L-shaped holding elements;

said controllably axially shifting means (36, 37; 46, 47) comprise spring-loaded axially movable plungers or pins (36, 37), and means (46, 47) for effecting controlled axial movements of said pins or plungers (36, 37).

5. The system of claim 4, wherein said means for effecting axial movements of the pins or plungers (36, 37) comprises fixed axial cam disks (46,47) on which said spring-loaded pins or plungers run as the separating cylinder (100) rotates.

6. The system of claim 4, further including spring means (42, 43) coupled to said pins or plungers (36, 37) and providing spring loadings therefor; and spring and pin holder means (44, 45) clamped on said pins or plungers (36, 37); and means (48) coupled to said pins or plungers inhibiting rotation of said pins or plungers while permitting axial movements thereof.

7. The system of claim 6, wherein said means for inhibiting rotation of said pins or plungers comprise slit guide pins (48).

8. The system of claim 1, wherein said holding or gripping means comprises pointed end portions (75) sequentially engageable, laterally from at least one side of the product into said partly creased end portion (101), whereby any one holding or gripping means penetrating between said product portions (7, 8) opens the product portion at the side for the next subsequent holding or gripping element;

and wherein said guide means (58) guiding the products about the circumference of the separating cylinder cooperate with said holding or gripping means to retain said sheet product on the circumference of the cylinder until the cylinder has rotated towards said terminal location.

9. The system of claim 1, wherein said controllably axially shifting means (36, 37, 46, 47) controls the leading gripping or holding means (38) to first laterally shift into said open end portion (101) and, when the separating cylinder is about to reach said terminal location, and approaches said fixed guide means (64, 65), first withdraws from said partly creased end portion (101) to permit the fold of the product to come free of said cylinder and enter said fixed guide means.

10. The system of claim 9, further including a pocket receiving and storage means (75) positioned below an outlet of said fixed guide means for introducing said then opened sheet products therein.

11. The system of claim 1, wherein said means for controllably axially shifting said holding means includes shaft support means (28, 29) for supporting a shaft (19) of said separating cylinder (100);

and wherein said cylinder includes disk means (33, 34, 35) clamped to said shaft (19) and having angled abutment means (54, 55, 56) secured to the circumference thereof against which the leading folded edge of the folded products can impinge for alignment thereof.

12. A method of separating individual product portions (7, 8) of a folded product (1) comprising receiving a flat product and folding said product to form a folded product having a crease fold line in a central region while leaving only partly creased end portions (101);

guiding said thus folded products about a portion of the circumference of a rotating cylinder (100) while axially introducing, sequentially, holding elements (38–41) forming a group, into the partly creased end portion (101), in which each of a first holding element is positioned close to the crease fold while the remaining holding elements of the group are positioned sequentially further along the length of the folded product (1);

stripping said products off the cylinder by engaging a fixed guide means (59, 60) against the folded crease line, while successively axially withdrawing said holding elements (38–41) from the folded product, said holding elements retaining that one (8) of the sheet portions against the rotating cylinder which is closest to its circumference, while permitting the other sheet portion (7) to come free of the cylinder under centrifugal force to thereby separate said sheet portions.

13. The method of claim 12, wherein said step of guiding said folded products about a portion of the circumference of the rotating cylinder includes engaging guide means (58) against that one of the product portions (7) which is remote from the cylinder over a fraction of the circumference of said cylinder.

14. The method of claim 13, including the step of delivering the stripped separated sheet portions (1, 7, 8) to a receiving structure (75) having receiving pockets and separating means (64, 65) thereon, said separating means being insertable between said then separated sheet portions (7, 8).

15. The method of claim 12, including the step of transporting said folded products in reverse imbricated form to said separating cylinder (100), in which the leading, folded edge of said products is placed beneath or below the trailing end portion of a preceding folded product (1).

* * * * *